US005659221A

United States Patent [19]

Coushaine et al.

[11] Patent Number: 5,659,221

[45] Date of Patent: Aug. 19, 1997

[54] HIGH INTENSITY DISCHARGE HEADLAMP ASSEMBLY

[75] Inventors: Charles M. Coushaine, Rindge; John L. Tremblay, Hopkinton, both of N.H.; Peter H. Corsini, Sandwich, Mass.

[73] Assignee: Osram Sylvania, Inc., Danvers, Mass.

[21] Appl. No.: 623,316

[22] Filed: Mar. 26, 1996

[51] Int. Cl.[6] ..... H01J 1/62; H01J 63/04; H01J 5/48; H01J 5/50

[52] U.S. Cl. ..... 313/493; 313/318.01; 313/318.1; 313/578; 362/226

[58] Field of Search ..... 313/51, 318.01–318.11, 313/493, 578–79; 439/602, 603, 611, 734; 362/226, 296, 308

[56] References Cited

U.S. PATENT DOCUMENTS

| | | | |
|---|---|---|---|
| 4,734,612 | 3/1988 | Sasaki et al. | 313/15 |
| 4,754,373 | 6/1988 | Otto et al. | 362/61 |
| 5,032,758 | 7/1991 | Davenport et al. | 313/113 |
| 5,036,439 | 7/1991 | Hoffmann et al. | 362/61 |
| 5,039,904 | 8/1991 | Kosmatka et al. | 313/318 |
| 5,051,658 | 9/1991 | Van Pijkeren | 315/82 |
| 5,059,855 | 10/1991 | Irisawa et al. | 313/318 |
| 5,130,911 | 7/1992 | Eisner, Sr. | 362/226 |
| 5,291,092 | 3/1994 | Coushaine | 313/318 |
| 5,313,135 | 5/1994 | Fletcher | 313/318.1 |
| 5,339,002 | 8/1994 | Braun et al. | 313/318.01 |

*Primary Examiner*—Sandra L. O'Shea
*Assistant Examiner*—Mack Haynes
*Attorney, Agent, or Firm*—Wolf, Greenfield & Sacks, P.C.

[57] ABSTRACT

Lamp assemblies, typically utilized in vehicle headlamps, include an arc discharge lamp, a base assembly and a mounting flange. The discharge lamp and the base assembly are movable relative to the mounting flange during focusing and are secured in a fixed position relative to the mounting flange following focusing of the discharge lamp. In a first embodiment, the base assembly includes a base, a wedge for holding the discharge lamp and an igniter attached to the base. An RF ring is located in a channel between the base and the mounting flange. The RF ring is fused to the base and to the mounting flange following focusing. In a second embodiment, the mounting flange and the base have mating spherical surfaces which permit a light-emitting portion of the discharge lamp to be moved laterally with respect to the mounting flange axis during focusing. In a third embodiment, the igniter is attached to the mounting flange and is electrically connected to the discharge lamp by flexible electrical leads, thereby permitting the mounting flange and igniter to be moved relative to the base assembly and the discharge lamp during focusing.

15 Claims, 11 Drawing Sheets

HIGH INTENSITY DISCHARGE HEADLAMP ASSEMBLY

FIELD OF THE INVENTION

This invention relates to small volume arc discharge lamps and, more particularly, to a support structure for small volume arc discharge lamps typically used in automobiles and other vehicles.

BACKGROUND OF THE INVENTION

Small volume arc discharge lamps are being developed for use as vehicle headlamps. These lamps offer long service lives and have high electrical efficiency. In addition, such lamps have small optical sources and thus are well adapted to headlamp optics. The enclosed volume of such lamps is roughly that of a pea, so the lamp may be fabricated from a small diameter quartz tube. Since the light source itself is small, the reflector optics may be made correspondingly small.

In order to obtain the required light output pattern, the arc tube must be precisely located within a reflector. The requirement for precise positioning of the arc tube in the reflector and for focusing the lamp assembly may cause difficulties in manufacturing. Additionally, when ignited, the arc tube becomes hot, thereby requiring that support materials for the arc tube be able to withstand high temperature operation. Although metals and ceramics have been used to support arc tubes in the past because of their ability to withstand high temperatures, these materials are hard. Thus, precise mounting of the arc tube using a metal or ceramic support structure can cause stress in the arc tube. Since the conventional manufacture of arc tubes and support structures normally results in some dimensional variation, some manufactured arc tubes will have high pressure contact and high stress, whereas others will have low contact pressure and low stress. Coupling stress is made worst by thermal expansion and contraction of the components as the arc tube is turned on and off. Finally, the arc tube can be caused to fracture if a portion of it is pinched in a support structure. Thus, the need exists for an arc discharge headlamp assembly that can withstand the temperatures of operation and still allow the arc discharge tube to be precisely positioned and focused without applying excessive stress to the tube.

A related problem concerns the energy management of the arc tube. The physics of the arc process is carefully designed for a particular operating temperature. Where thermal conduction from an arc tube differs from the design value, for example, when the support structure has a relatively low or relatively high amount of contact with the arc tube, heat builds up or is lost too quickly from the arc tube. In this situation, the physics of the arc changes, thereby affecting the lamp optics and color. There is a need for a support structure that forms a consistent thermal contact from one arc tube to the next.

U.S. Pat. No. 4,734,612 issued Mar. 29, 1988 to Sasaki et al discloses a double ended lamp capsule with leads welded to support wires. One support wire extends through an insulating sleeve and then in parallel with a second wire extends through a seal area of an enclosing capsule.

U.S. Pat. No. 4,754,373 issued Jun., 28, 1988 to Otto et al discloses a double ended filament lamp capsule positioned in an automotive headlamp reflector. The reference discloses a structure in which a double ended lamp capsule may be welded and axially aligned as part of a headlamp.

U.S. Pat. No. 5,032,758 issued Jul. 16, 1991 to Davenport et al discloses an arc discharge lamp axially aligned in a reflector.

U.S. Pat. No. 5,036,439 issued Jul. 30, 1991 to Hoffmann et al discloses a double ended arc discharge lamp held in a metal reflector or shield. The reflector includes spring tabs that press against the lamp tube to properly position the shield.

U.S. Pat. No. 5,039,904 issued Aug. 13, 1991 to Kosmatka et al discloses a double ended arc discharge tube axially mounted in a headlamp. One end of the tube is secured in a threaded structure including 0-rings. The forward lead extends away from the lamp capsule and passes through the reflector body for exterior electrical connection.

U.S. Pat. No. 5,051,658 issued Sep. 24, 1991 to VanPijkeren discloses a double ended arc discharge tube wherein one end is pinched between two metal arms. The arms are supported on a bushing that is in turn connected to a tube and holder body.

U.S. Pat. No. 5,059,855 issued Oct. 22, 1991 to Irisawa et al discloses a double ended arc discharge tube welded by its leads at each end. The forward lead extends back through an insulating sleeve to a base. The leads are ducted through the body of the base.

U.S. Pat. No. 5,130,911 issued Jul. 14, 1992 to Eisner, Sr. discloses a two-piece lamp retainer for holding a press sealed tungsten halogen capsule in a headlamp.

U.S. Pat. No. 5,291,092 issued Mar. 1, 1994 to Coushaine discloses a double ended arc discharge headlamp assembly including an arc tube, wedge, retainer, forward connector rod, insulating sleeve, RF ring and base. The wedge secures one end of the arc tube and is compressed along its exterior by the retainer. The lamp, wedge and retainer are movable relative to the base to permit alignment. Following alignment, the RF ring is fused to the base and to the retainer.

Pending application Ser. No. 08/354,508 filed Dec. 13, 1994 discloses a double ended arc discharge headlamp assembly wherein a split ball assembly is mounted about one end of an arc discharge tube. The split ball assembly is held in place by concave portions in the base and by a locking nut.

SUMMARY OF THE INVENTION

According to the present invention, a lamp assembly typically utilized for vehicle headlamp applications is provided. The lamp assembly comprises a discharge lamp having a tubular end, a base assembly positioned around and secured to the tubular end of the discharge lamp for mechanically supporting the discharge lamp, and a mounting flange secured to the base assembly for mounting the lamp assembly in a lamp fixture. The base assembly includes an igniter for supplying electrical energy to the discharge lamp. The assembly further includes electrical connections between the igniter and the discharge lamp. The mounting flange is movable with respect to the base assembly during focusing of the discharge lamp and is secured in a fixed position with respect to the base assembly following the focusing of the discharge lamp.

In a first embodiment of the invention, the base assembly further includes a base having an outer periphery that contacts the mounting flange, a wedge mounted in the base for securing the discharge lamp in the base assembly and a cover for enclosing the igniter. The base may be provided with a channel around its outer periphery adjacent to the mounting flange. The lamp assembly further comprises an RF ring positioned in the channel. The RF ring is fused to the base and to the mounting flange following focusing of the discharge lamp. In this embodiment, the discharge lamp and the base assembly are axially movable with respect to the mounting flange during focusing, and a light-emitting portion of the discharge lamp is laterally movable with respect to the mounting flange axis during focusing.

In a second embodiment of the invention, the base and the mounting flange have mating spherical surfaces which are movable relative to each other during focusing of the discharge lamp. A light-emitting portion of the discharge lamp is laterally movable with respect to the mounting flange axis during focusing.

According to another aspect of the invention, a lamp assembly comprises a discharge lamp having a tubular end, a base assembly positioned around and secured to the tubular end of the discharge lamp for mechanically supporting the discharge lamp, and a mounting flange assembly for mounting the lamp assembly in a lamp fixture. The mounting flange assembly includes a mounting flange secured to the base assembly and an igniter attached to the mounting flange. The mounting flange is movable with respect to the base assembly during focusing of the discharge lamp and is secured in a fixed position with respect to the base assembly following focusing of the discharge lamp. The lamp assembly further includes flexible electrical leads connected between the igniter and the discharge lamp, so that the mounting flange assembly is movable with respect to the base assembly and the discharge lamp during focusing of the discharge lamp.

In a third embodiment of the invention, the base assembly includes a base having an outer periphery that contacts the mounting flange and a wedge mounted in the base for securing the discharge lamp in the base assembly. The base includes a channel around its outer periphery. The lamp assembly preferably further includes an RF ring positioned in the channel and fused to the mounting flange and to the base following focusing of the discharge lamp. A light-emitting portion of the discharge lamp is movable along the mounting flange axis and is movable laterally with respect to the mounting flange axis during focusing.

BRIEF DESCRIPTION OF THE DRAWINGS

For a better understanding of the present invention, reference is made to the accompanying drawings, which are incorporated herein by reference and in which.

DETAILED DESCRIPTION

Figure 1:
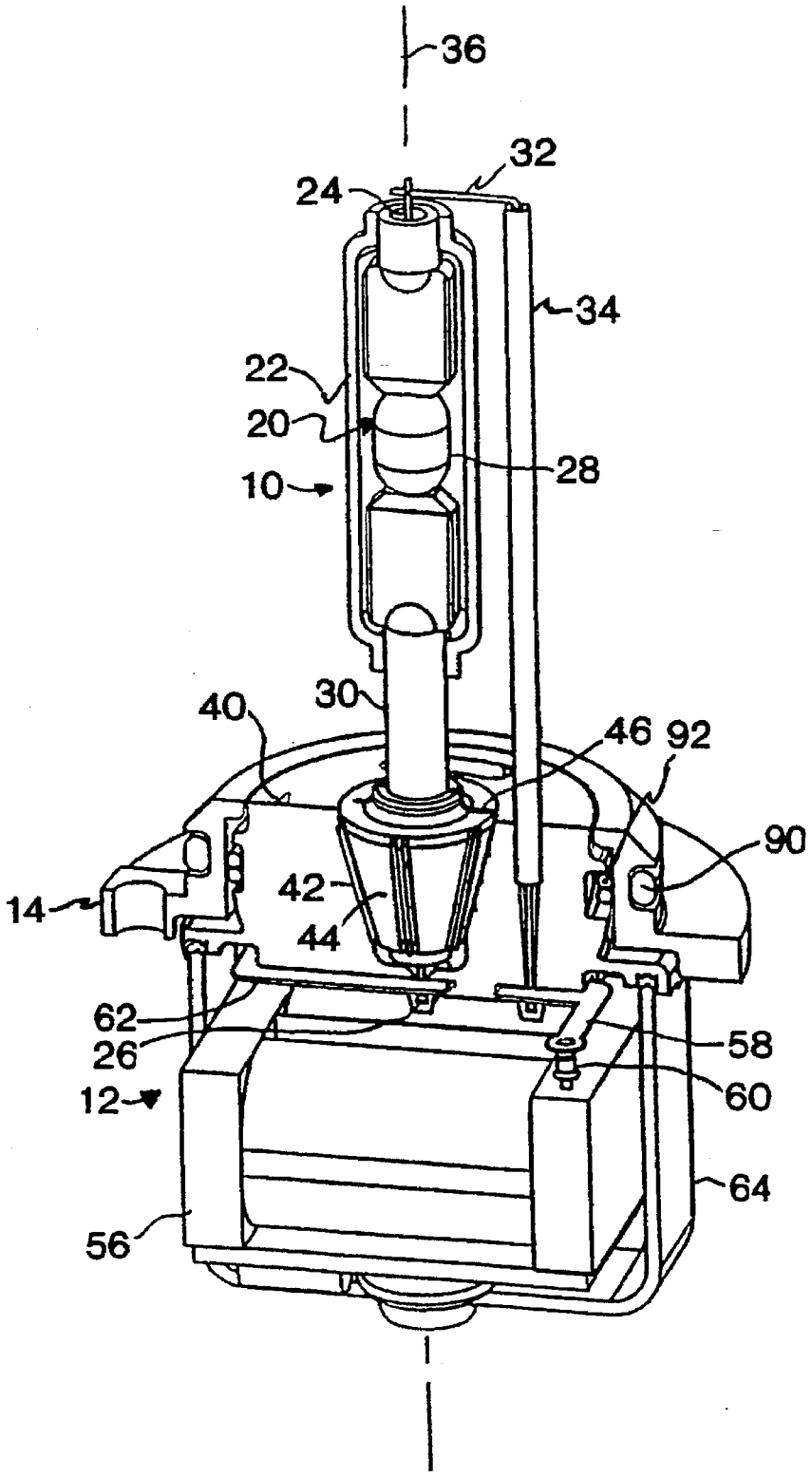
FIG. 1 is a partially cut away, isometric view of a lamp assembly in accordance with a first embodiment of the invention.
Figure 2:
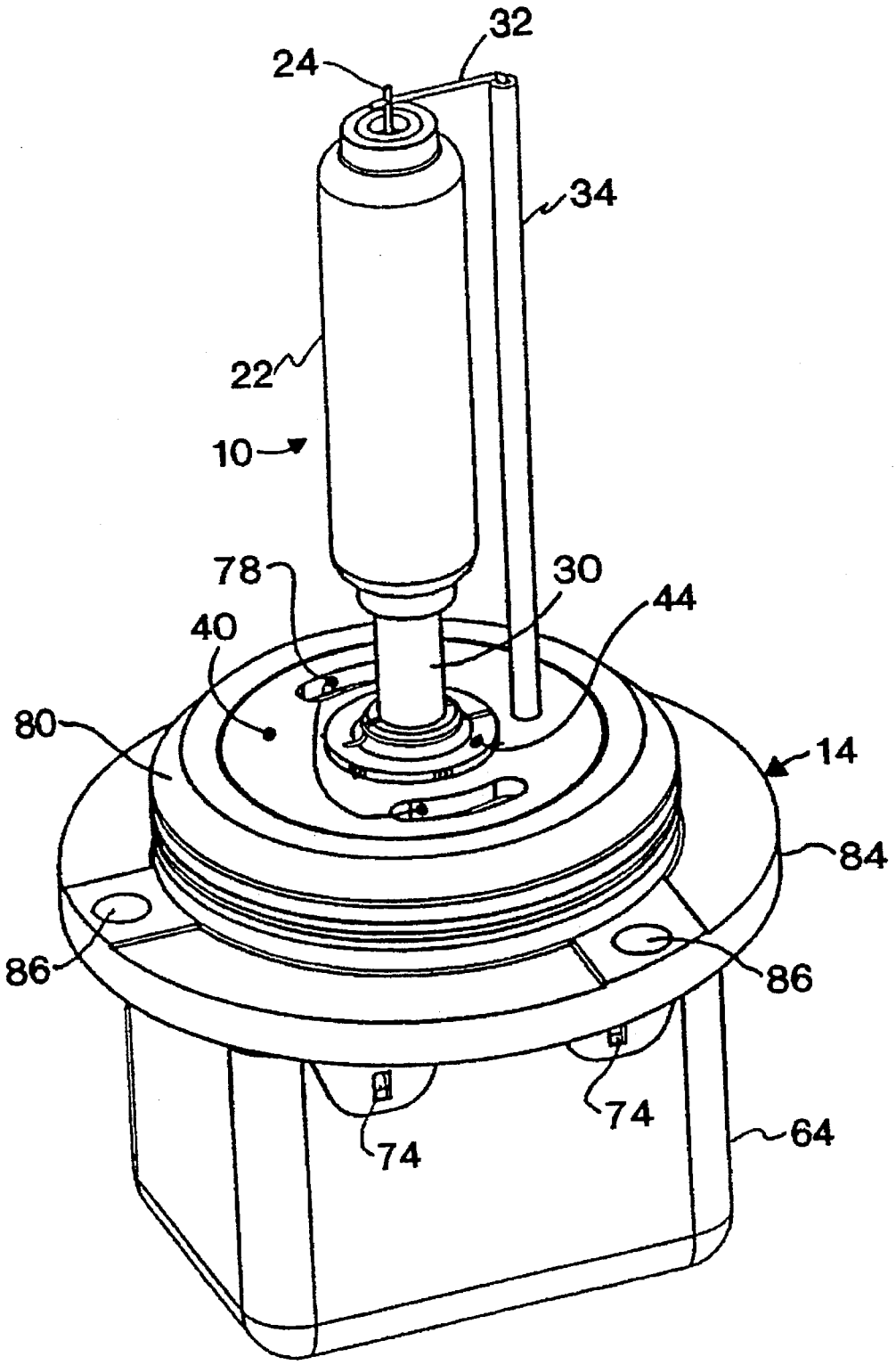
FIG. 2 is an isometric view of the complete lamp assembly of FIG. 1.

A lamp assembly in accordance with a first embodiment of the invention is shown in FIGS. 1–6. The lamp assembly includes a discharge lamp 10, a base assembly 12 and a mounting flange 14. The lamp assembly is typically utilized in a vehicle headlamp. The mounting flange 14 is secured to a mounting surface in a headlamp reflector (not shown). The discharge lamp 10 must be precisely located with respect to the focal point of the reflector to obtain a desired light pattern.

The discharge lamp 10 includes a double-ended arc tube 20 and an outer jacket 22. The double-ended arc tube 20 may be formed from a quartz tube and includes an upper electrical lead 24 extending from an upper end of the quartz tube and a lower electrical lead 26 extending from a lower end of the quartz tube. The electrical leads 24 and 26 are typically press sealed into the quartz tubing. The arc tube 20 may vary in size and shape. By way of example, a light-emitting portion 28 of arc tube 20 may have an approximately elliptical shape, with an enclosed volume of about 0.2 to about 0.5 milliliters. The outer jacket 22 has a generally cylindrical configuration. The arc tube 20 has a tubular lower end 30 for mechanical support of the discharge lamp 10 by base assembly 12. A lead wire 32 is connected between upper electrical lead 24 and base assembly 12. A portion of lead wire 32 adjacent to discharge lamp 10 is enclosed in a ceramic sleeve 34.

Figure 3:
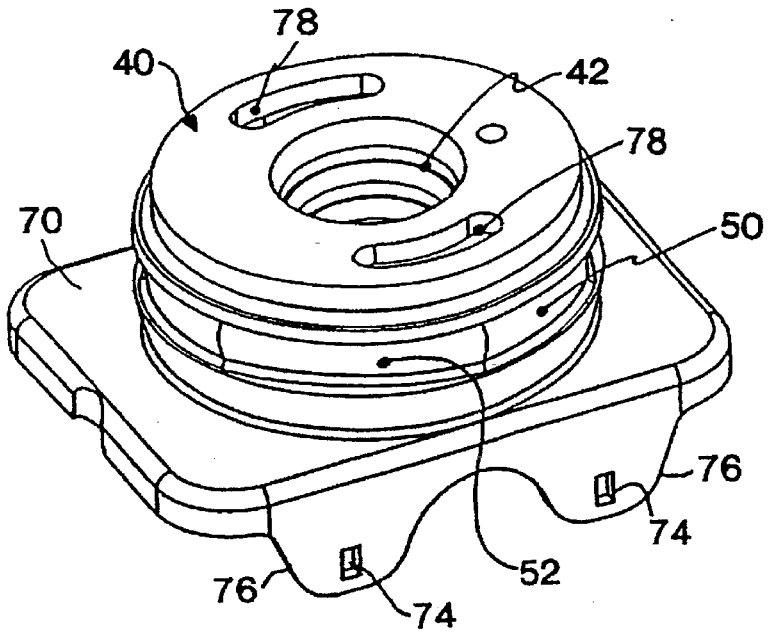
FIG. 3 is a top isometric view of the base used in the lamp assembly of FIG. 1.
Figure 4:
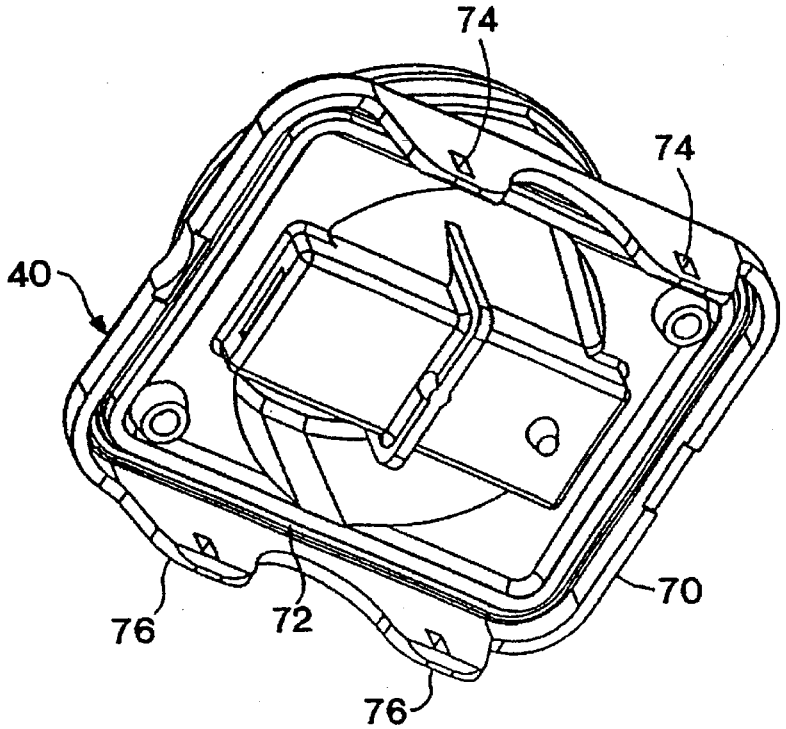
FIG. 4 is a bottom isometric view of the base shown in FIG. 3.

The base assembly 12 includes a base 40, shown separately in FIGS. 3 and 4. The base 40 is provided with a truncated conical opening 42 for receiving a split wedge 44. The split wedge 44 has a cylindrical central opening for receiving the tubular lower end 30 of arc tube 20 and has a truncated conical outer shape that matches opening 42 in base 40. The wedge 44 includes a gap 46 that permits limited flexure, so that the wedge 44 may be pressed into contact with the tubular lower end 30 of arc tube 20. The wedge 44 is sonically welded to base 40 such that the compressed wedge gently but firmly holds the discharge lamp 10. Details of the wedge construction and operation are disclosed in U.S. Pat. No. 5,291,092, which is hereby incorporated by reference.

The base 40 is provided on its outer periphery with a circumferential channel 50 for receiving an RF ring. The channel 50 preferably includes spreaders 52 that cause the channel 50 to have a varying diameter around its circumference, as described in the aforementioned U.S. Pat. No. 5,291,092.

The base assembly 12 further includes an igniter 56 that provides suitable voltages and currents for starting and operating discharge lamp 12. The igniter 56 receives electrical energy from the vehicle power system. A first contact 58 is connected between lead wire 32 and a first terminal 60 of igniter 56. A second contact 62 is connected between lower electrical lead 26 of arc tube 20 and a second terminal (not shown) of igniter 56. The first contact 58 and the second contact 52 each comprise a relatively rigid, electrically-conductive metal strip. Igniter circuits for discharge lamps of the type described herein are well known to those skilled in the art.

A cover 64 encloses igniter 56 and is secured to base 40. In particular, base 40 may include a generally rectangular flange 70 (FIGS. 3 and 4) having a groove 72 on its underside for engaging an upper edge of cover 64. The groove 72 may be provided with a gasket for sealing cover 64 to base 40. The cover 64 may be provided with projections (not shown) which engage openings 74 formed in downwardly extending portions 76 of flange 70. A connector 66 mounted in cover 64 permits the lamp assembly to be electrically connected to the vehicle power system. The base 40 may be provided with one or more apertures 78 for introducing a potting compound into an interior region of cover 64 containing igniter 56. The base assembly 12, which includes base 40, wedge 44, contacts 58 and 62, igniter 56 and cover 64, is movable with discharge lamp 10 relative to mounting flange 14 during focusing of the discharge lamp 10 in the lamp assembly.

Figure 5:
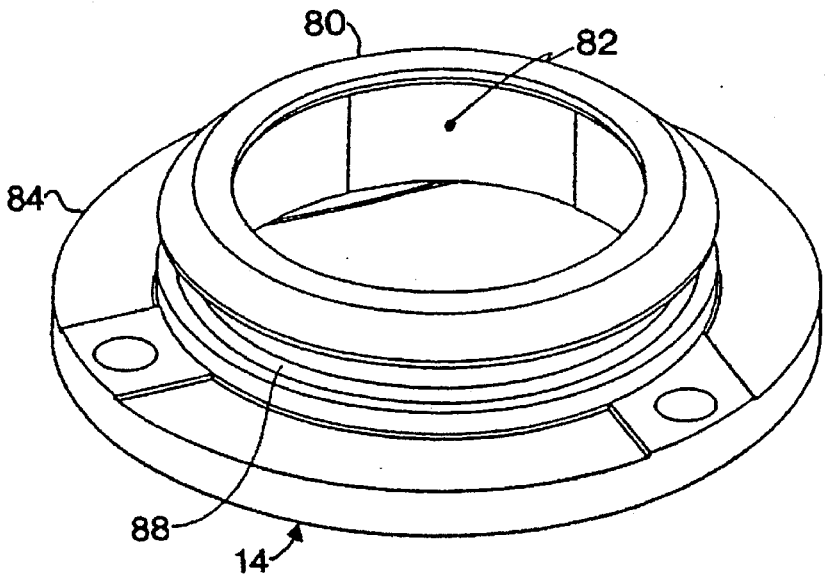
FIG. 5 is a top isometric view of the mounting flange used in the lamp assembly of FIG. 1.
Figure 6:
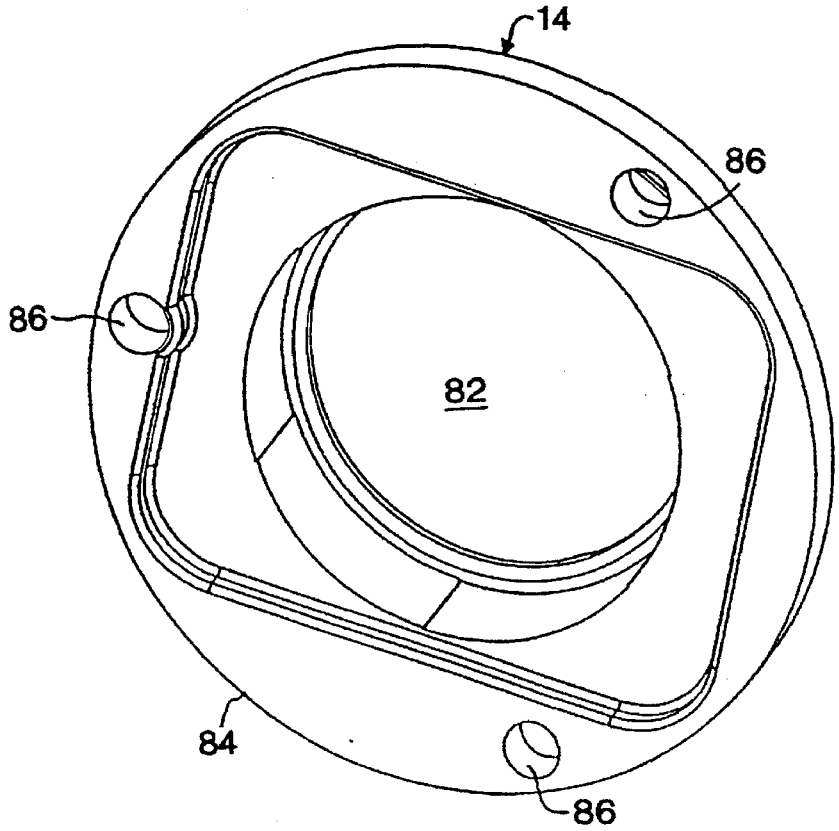
FIG. 6 is a bottom isometric view of the mounting flange shown in FIG. 5.

As best shown in FIGS. 5 and 6, the mounting flange 14 has a generally circular configuration, including a circular ring 80 defining a central opening 82 for receiving the base assembly 12. The mounting flange 14 further includes a flange 84 having mounting holes 86 for securing the lamp assembly to a reflector. The ring 80 is provided on its outer periphery with a groove 88 for an elastomer ring 90 (FIG. 1) for sealing the lamp assembly to the reflector. The mounting flange has a central axis 36, shown in FIG. 1.

The lamp assembly is assembled as follows. The discharge tube 10 is inserted through wedge 44 and contact 62 is inserted into base 40 until it snaps around lower electrical lead 26. An initial rough prefocussing places the discharge lamp 10 close to its correct focal position. In order to prefocus the assembly, the discharge lamp 10 is energized in a test fixture by making electrical contact to upper electrical lead 24 and second contact 62. The discharge lamp 10 is moved relative to wedge 44 to obtain a desired light position. Then, the wedge 44 is ultrasonically welded to base 40.

Next, lead wire 32 is inserted into ceramic sleeve 34 and then into base 40. The lead wire 32 is welded to electrical lead 24, and contact 58 is inserted into base 40 to make contact with lead wire 32. An RF ring 92 is then placed in the channel 50 of base 40. At this time, the cover 64 and the igniter 56 are snapped onto the base assembly. The assembly is topped off with potting compound through the apertures 78.

The mounting flange 14 is now slid down over the base assembly and makes contact with RF ring 92. The RF ring 92 contacts the surfaces of channel 50 as described in the aforementioned U.S. Pat. No. 5,291,092. The discharge lamp 10 is focussed in x, y and z directions in relation to the mounting flange 14. Either the mounting flange 14 or the base assembly 12 may be held fixed and the other moved in relation to it. During focusing, the discharge lamp 10 and the base assembly 12 may be moved axially with respect to mounting flange 14, and the light-emitting portion 28 of discharge lamp 10 may be moved laterally with respect to mounting flange axis 36. In particular, the base 40 may be moved axially and may be tipped with respect to mounting flange 14. When the discharge lamp 10 is in a desired position relative to mounting flange 14, RF energy is applied to the assembly, causing the RF ring 92 to be fused to the base 40 and to the mounting flange 14. Thus, the discharge lamp 10 is permanently fixed in a desired location with respect to mounting flange 14. The assembly is now complete.

Figure 7:
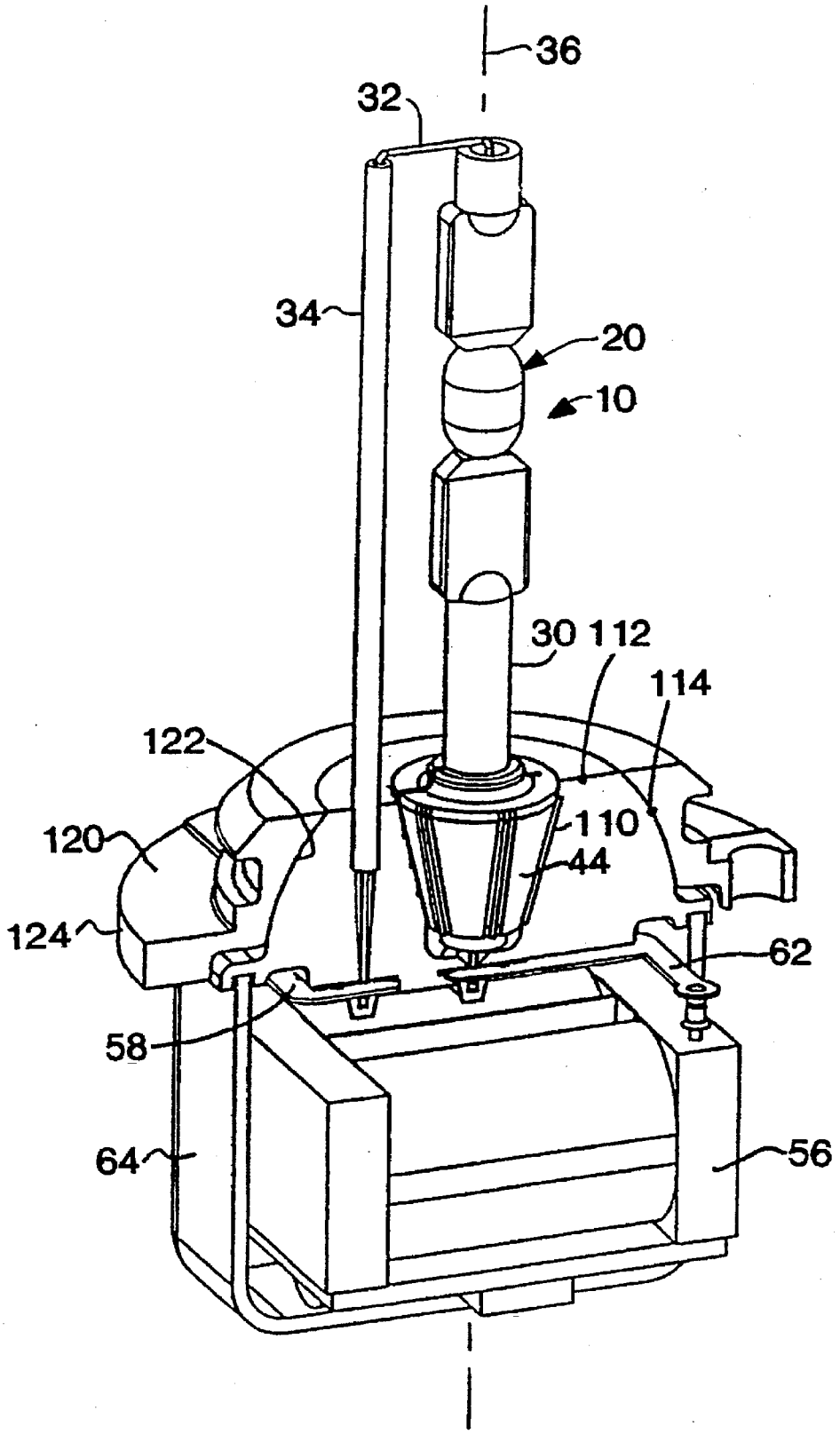
FIG. 7 is a partially cut away, isometric view of a lamp assembly in accordance with a second embodiment of the invention.
Figure 8:
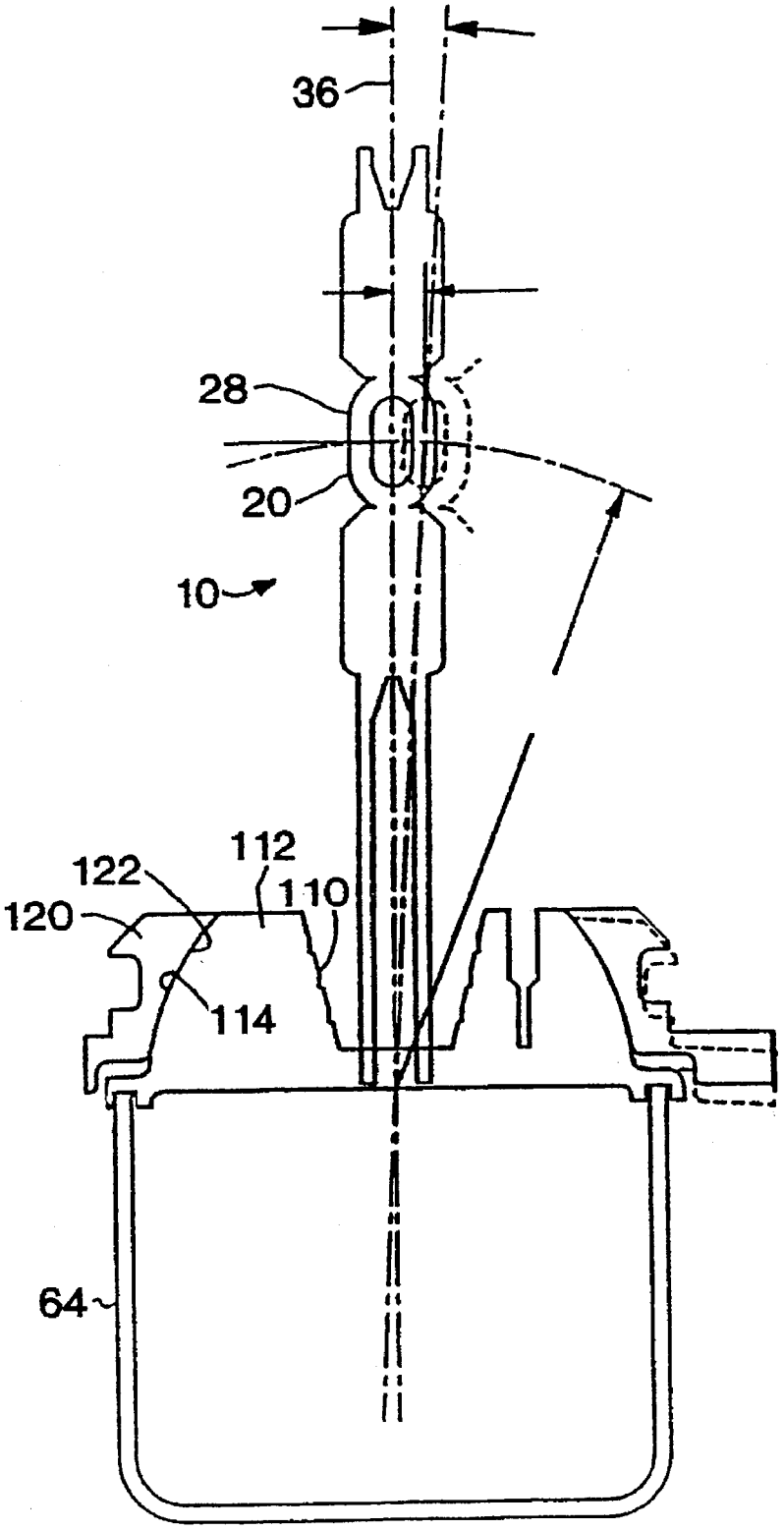
FIG. 8 is a schematic diagram of the lamp assembly of FIG. 7, illustrating focusing of the arc tube.
Figure 9:
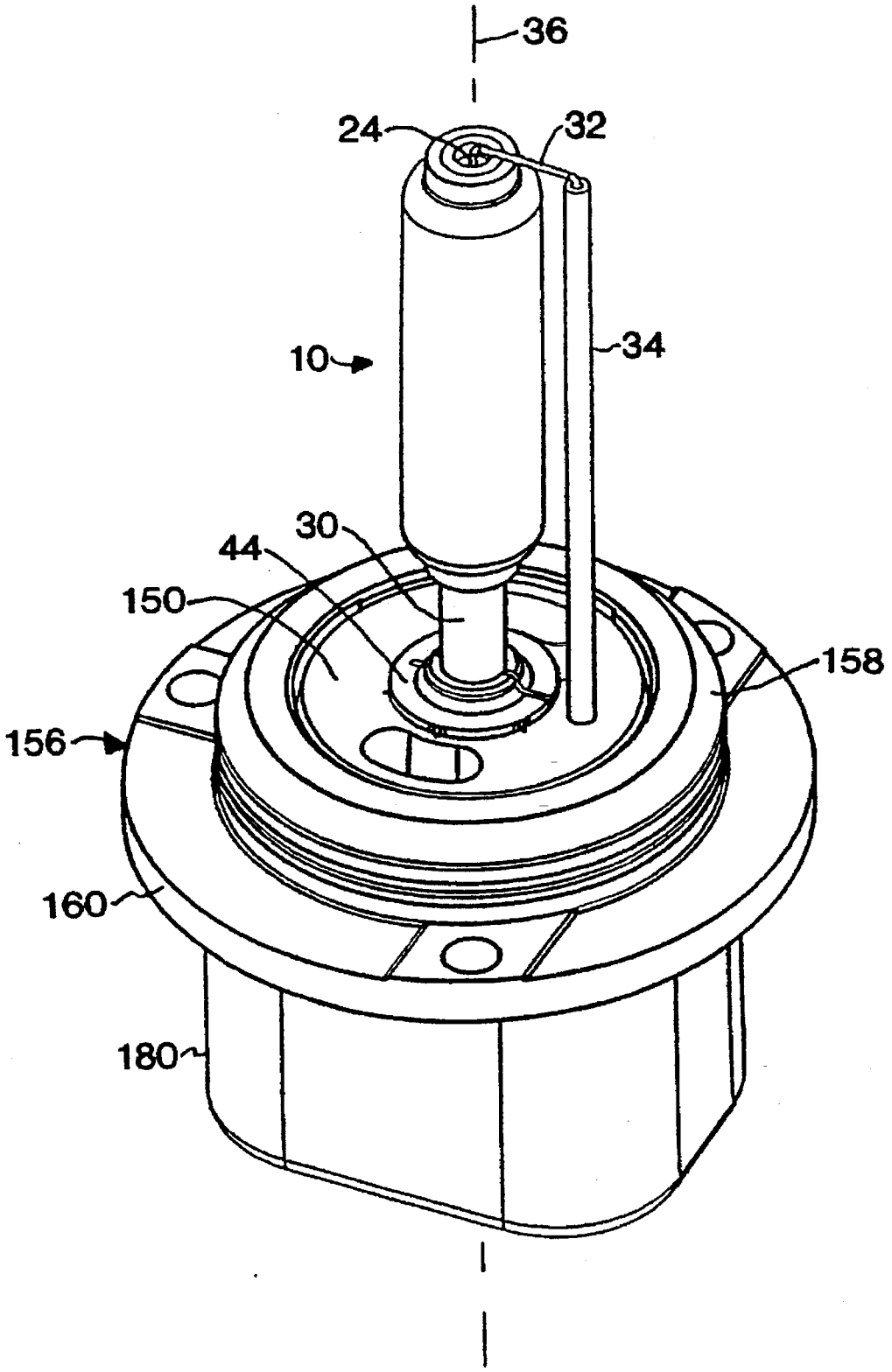
FIG. 9 is an isometric view of a lamp assembly in accordance with a third embodiment of the invention.
Figure 10:
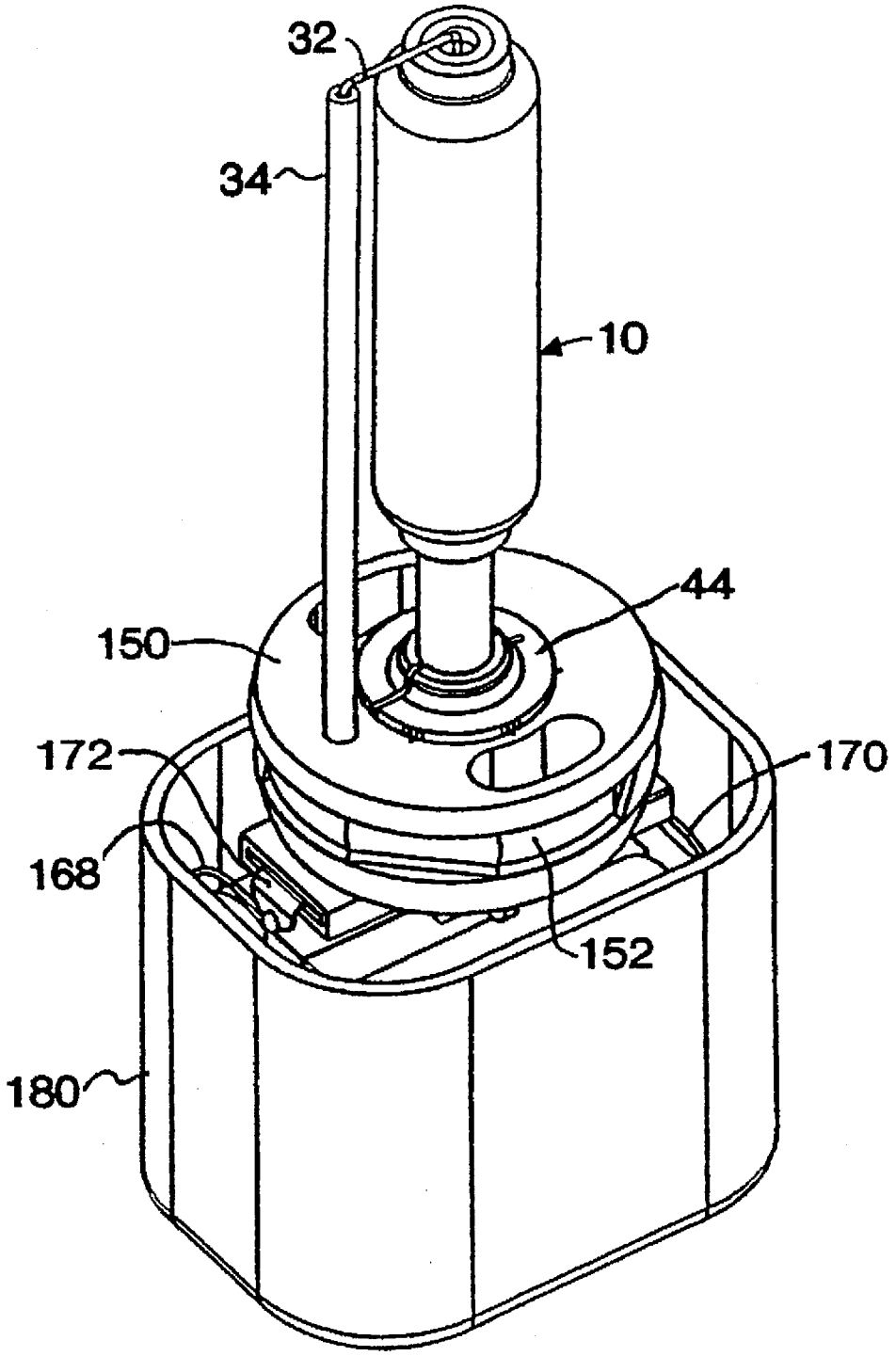
FIG. 10 is an isometric view of the lamp assembly of FIG. 9 with the mounting flange removed.
Figure 11:
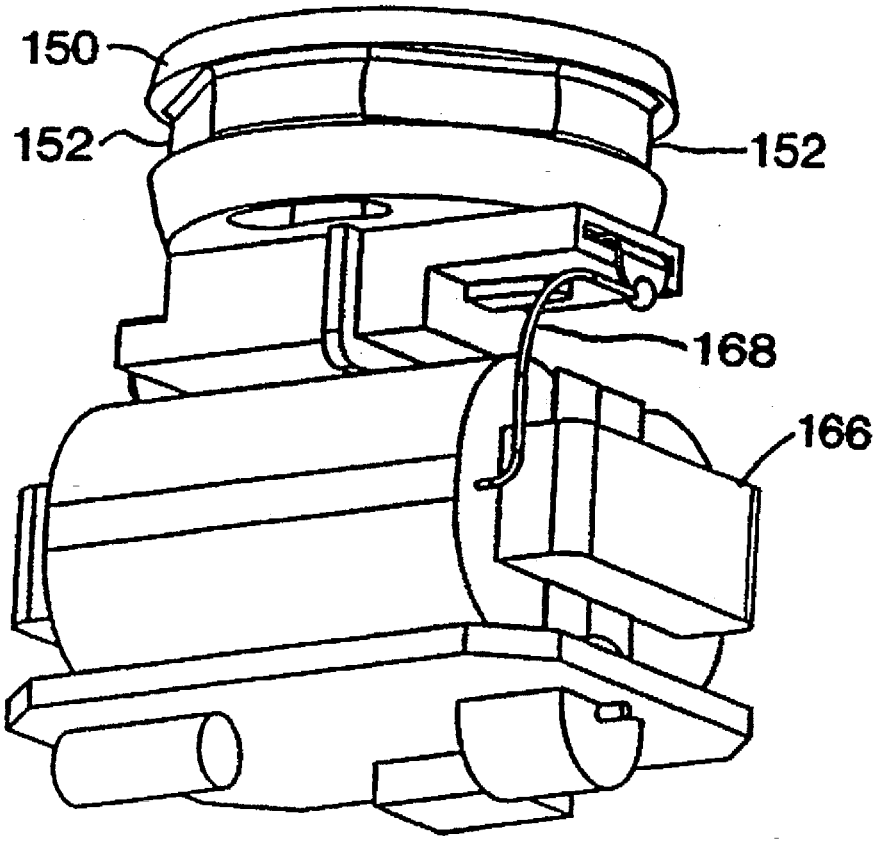
FIG. 11 is an isometric view of the igniter and base used in the lamp assembly of FIG. 9.

A second embodiment of the invention is shown in FIGS. 7 and 8. Like elements in FIGS. 1–8 have the same reference numerals. The outer jacket of discharge lamp 10 is omitted in FIG. 7 for simplicity of illustration. The embodiment of FIGS. 7 and 8 differs from the embodiment of FIGS. 1–6 primarily in the construction of the base and the mounting flange. As shown in FIG. 7, the wedge 44 which supports discharge lamp is mounted in a truncated conical opening 110 of a base 112. An outer peripheral surface 114 of base 112 has a spherical shape. A mounting flange 120 has a central opening with an inner surface 122 that is spherical in shape. The inner surface 122 of mounting flange 120 and the outer peripheral surface 114 of base 112 are matched in size and shape, so that the surfaces are in contact in the completed lamp assembly. The function of these surfaces in focusing of the discharge lamp 10 is described below. The mounting flange 120 includes a flange 124 for mounting the lamp assembly in a reflector (not shown) of a vehicle headlamp. The mounting of the igniter 56 and the connections between igniter 56 and discharge lamp 10 may be the same as described above in connection with the embodiment of FIGS. 1–6. Cover 64 is sealed to base 112 and encloses igniter 56. Base 112, wedge 44, contacts 58 and 62, igniter 56 and cover 64 constitute a base assembly that is movable with discharge lamp 10 relative to mounting flange 120 during focusing of the discharge lamp 10 in the lamp assembly.

The mating spherical surfaces 114 and 122 permit relative movement between base 112 and mounting flange 120. This movement is used during the focusing procedure to move the light-emitting portion 28 of discharge lamp 10 relative to axis 36 of the mounting flange 120 as shown in FIG. 8. As described above, the lamp assembly is mounted in a test fixture with the mounting flange 120 maintained in a fixed position. The discharge lamp is energized, and the base 112 is moved relative to mounting flange 120 until the light-emitting portion of discharge lamp 10 is in a desired location for proper focusing. Then, the surface 122 of mounting flange 120 is ultrasonically welded to surface 114 of base 112, thereby permanently focusing the lamp assembly.

Figure 12:
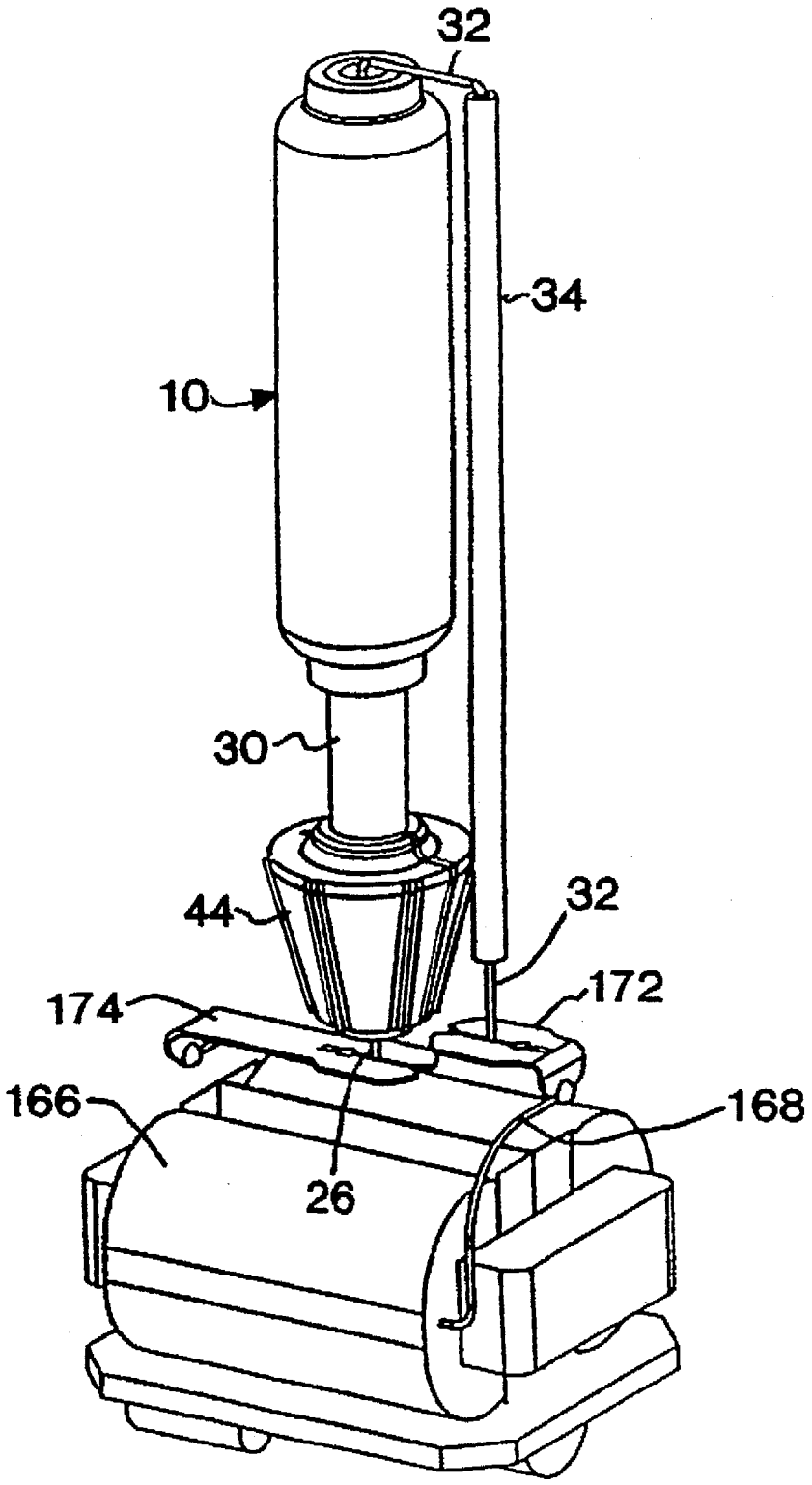
FIG. 12 is an isometric view of the igniter, wedge and arc tube used in the lamp assembly of FIG. 9.
Figure 13:
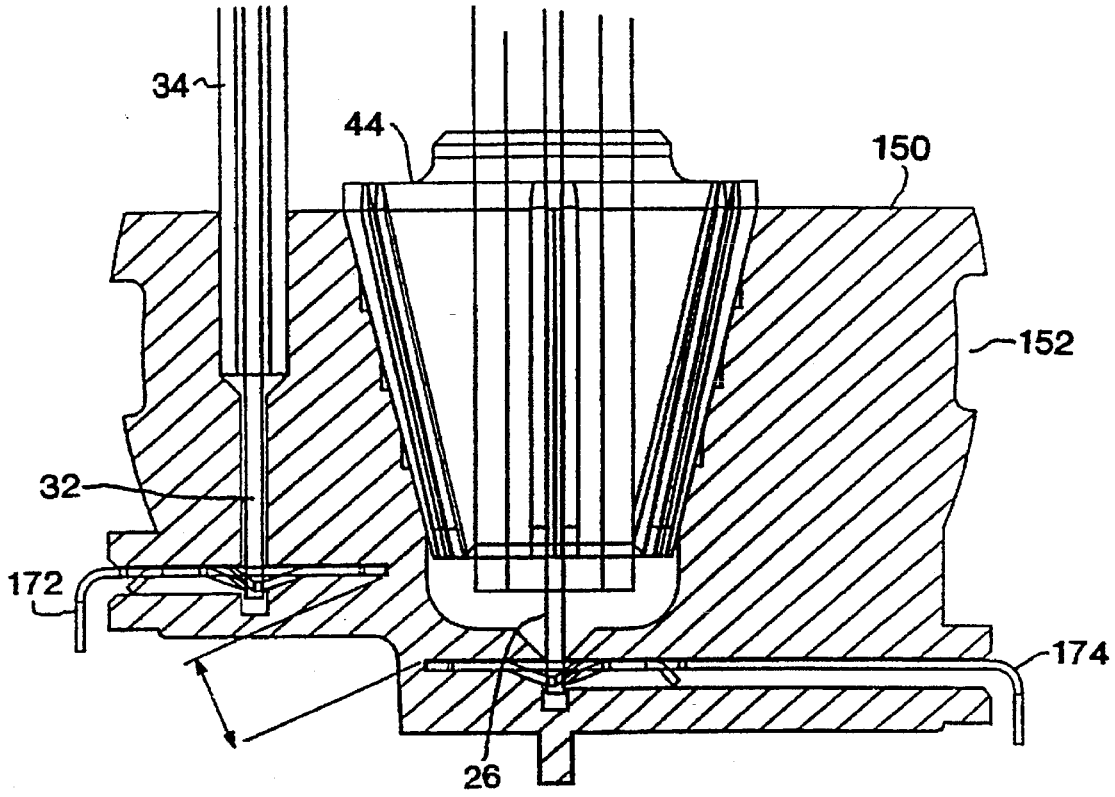
FIG. 13 is a partial, cross-sectional view of the lamp assembly of FIG. 9, showing the base, wedge and electrical connections.

A third embodiment of the invention is illustrated in FIGS. 9–13. Like elements in FIGS. 1—6 and 9–13 have the same reference numerals. The tubular lower end 30 of discharge lamp 10 is secured in wedge 44 as described above. The wedge 44 is mounted in a truncated conical opening in a base 150. The base 150 is provided with a peripheral channel 152 of varying diameter as described above in connection with the embodiment of FIGS. 1–6. The base 150 is mounted in a central opening of a mounting flange 156. The mounting flange 156 includes a circular ring 158 and a flange 160 for mounting the lamp assembly to a reflector (not shown). An igniter 166 is similar to igniter 56 described above, but includes flexible electrical leads 168 and 170 rather than fixed electrical terminals. Flexible lead 168 is electrically connected to a contact 172, and flexible electrical lead 170 is electrically connected to a contact 174. The contacts 172 and 174, which are semi-rigid conductive metallic strips, snap into base 150. Contact 172 snaps onto lead wire 32, and contact 174 snaps onto lower electrical lead 26, as best shown in FIGS. 12 and 13. The igniter 166 is enclosed by a cover 180. An interior region of cover 180 and containing igniter 166 may be filled with a potting compound. In contrast to the first and second embodiments, the cover 180 is sealed to mounting flange 156. However, because igniter 166 is connected by flexible leads 168 and 170 to contacts 172 and 174, respectively, the mounting flange 156 may be moved relative to base 150 during focusing of the lamp assembly. In the embodiment of FIGS. 9–13, base 150, wedge 44 and contacts 172 and 174 constitute a base assembly. The mounting flange 156, igniter 166 and cover 180 constitute a mounting flange assembly which may be moved relative to the base assembly and the discharge lamp 10 during focusing of discharge lamp 10 in the lamp assembly.

The focusing procedure in the embodiment of FIGS. 9–13 is similar to the focusing procedure of the first embodiment described above. An RF ring (not shown) is located in channel 152 between base 150 and mounting flange 156. During focusing, base 150 and discharge lamp 10 may be moved along axis 36 relative to mounting flange 156. In addition, the base 150 may be tipped relative to mounting flange 156, causing a light-emitting portion of discharge lamp 10 to be laterally displaced from mounting flange axis 36. When the discharge lamp 10 is located in a desired position relative to mounting flange 156, RF energy is applied to the assembly, causing the RF ring to be fused to the base 150 and to the mounting flange 156. Thus, the discharge lamp 10 is permanently fixed in a desired location with respect to mounting flange 156. The assembly is now complete.

The components of the lamp assemblies shown and described herein may be fabricated using various materials known to those of skill in the art. The materials must be capable of meeting the strength and temperature requirements of the lamp assembly application. The base, wedge, mounting flange and cover are preferably fabricated of high temperature plastics. It will be understood that other materials may be utilized within the scope of the present invention.

While there have been shown and described what are at present considered the preferred embodiments of the present invention, it will be obvious to those skilled in the art that various changes and modifications may be made therein without departing from the scope of the invention as defined by the appended claims.

What is claimed is:

1. A lamp assembly comprising:

a discharge lamp having a tubular end;

a base assembly positioned around and secured to the tubular end of said discharge lamp for mechanically supporting said discharge lamp, said base assembly including an igniter for supplying electrical energy to said discharge lamp;

electrical connections between said igniter and said discharge lamp; and a mounting flange secured to said base assembly for mounting said lamp assembly in a lamp fixture, said mounting flange being movable with respect to said base assembly during focusing of said discharge lamp and being secured in a fixed position with respect to said base assembly following focusing of said discharge lamp.

2. A lamp assembly as defined in claim 1 wherein said base assembly further includes a base having a outer periphery that contacts said mounting flange, a wedge mounted in said base for securing said discharge lamp in said base assembly and a cover for enclosing said igniter.

3. A lamp assembly as defined in claim 2 wherein said base is provided with a channel around its outer periphery adjacent to said mounting flange and wherein said lamp assembly further comprises an RF ring positioned in said channel, said RF ring being fused to said base and to said mounting flange following focusing of said discharge lamp.

4. A lamp assembly as defined in claim 2 wherein said mounting flange has a central axis and wherein said discharge lamp and said base assembly are movable along said axis with respect to said mounting flange during focusing, and wherein a light-emitting portion of said discharge lamp is laterally movable with respect to said axis during focusing.

5. A lamp assembly as defined in claim 2 wherein said cover is secured to said base.

6. A lamp assembly as defined in claim 2 wherein the electrical connections between said igniter and said discharge lamp comprise semi-rigid conductive contacts secured to said igniter and lead wires connected between said discharge lamp and said contacts.

7. A lamp assembly as defined in claim 2 wherein said base and said mounting flange have mating spherical surfaces which are movable relative to each other during focusing of said discharge lamp.

8. A lamp assembly as defined in claim 7 wherein said mounting flange has a central axis and wherein a light-emitting portion of said discharge lamp is laterally movable with respect to said axis during focusing by relative movement of said spherical surfaces.

9. A lamp assembly as defined in claim 1 wherein a light-emitting portion of said discharge lamp is movable in three dimensions with respect to said mounting flange during focusing.

10. A lamp assembly comprising:

a discharge lamp having a tubular end;

a base assembly positioned around and secured to the tubular end of said discharge lamp for mechanically supporting said discharge lamp;

a mounting flange assembly for mounting said lamp assembly in a lamp fixture, said mounting flange assembly including a mounting flange secured to said base assembly and an igniter attached to said mounting flange for supplying electrical energy to said discharge lamp, said mounting flange being movable with respect to said base assembly during focusing of said discharge lamp and being secured in a fixed position with respect to said base assembly following focusing of said discharge lamp; and flexible electrical leads connected between said igniter and said discharge lamp so that said mounting flange assembly is movable with respect to said base assembly and said discharge lamp during focusing of said discharge lamp.

11. A lamp assembly as defined in claim 10 wherein base assembly includes a base having an outer periphery that contacts said mounting flange and a wedge mounted in said base for securing said discharge lamp in said base assembly.

12. A lamp assembly as defined in claim 11 wherein base includes a channel around its outer periphery and wherein said lamp assembly further includes an RF ring positioned in said channel and fused to said mounting flange and to said base following focusing of said discharge lamp.

13. A lamp assembly as defined in claim 11 wherein said mounting flange includes a central axis and wherein a light-emitting portion of said discharge lamp is movable along said axis and is movable laterally with respect to said axis during focusing.

14. A lamp assembly as defined in claim 11 wherein said mounting flange assembly further includes a cover secured to said mounting flange for enclosing said igniter.

15. A lamp assembly as defined in claim 11 wherein said base assembly further includes a pair of semi-rigid electrical contacts secured in said base and electrically connected between said discharge lamp and said flexible leads.

* * * * *